United States Patent [19]

Cushing

[11] 4,119,386

[45] Oct. 10, 1978

[54] MOP ASSEMBLY TO DISTRIBUTE SELECTED LIQUIDS ON FLOOR AREAS, TO BE WAXED, CLEANED, AND/OR STRIPPED

[76] Inventor: Ernest W. Cushing, 3229 S. 135th, Seattle, Wash. 98168

[21] Appl. No.: 694,771

[22] Filed: Jun. 10, 1976

[51] Int. Cl.[2] ..... A47L 1/08

[52] U.S. Cl. ..... 401/138; 401/205

[58] Field of Search ..... 401/138, 40–42, 401/196, 205–207, 140

[56] References Cited

U.S. PATENT DOCUMENTS

| | | | |
|---|---|---|---|
| 1,021,708 | 3/1912 | Schaeneman | 401/205 |
| 2,073,170 | 3/1937 | Pieper | 401/138 |
| 2,187,671 | 1/1940 | Suddarth | 401/205 |
| 2,551,220 | 5/1951 | Ploner | 401/139 |
| 2,575,124 | 11/1951 | Pollitt | 401/138 X |
| 3,114,922 | 12/1963 | Rallantyne | 401/138 X |

*Primary Examiner*—Stephen C. Pellegrino
*Attorney, Agent, or Firm*—David H. Deits; Roy E. Mattern, Jr.

[57] ABSTRACT

A mop assembly is provided to uniformly and controllably apply and distribute liquids to the surfaces of exposed floors. A tank having a teardrop shape in the transverse plane maintains a low center of gravity and a relatively thin cross-section which along with the handle passing centrally through the tank permits the mop assembly to be used under low obstructions. Clamps around shouldered openings at either end of the tank through which the handle passes seal the tank. A control rod inside a sleeve passing through the tank permits operation of a control valve on a discharge port at the bottom of the tank. One head attachable to the mop assembly consists of a plate to which a porous pad is attached. The liquid is fed through tubing connected to the discharge port to dispense liquid through the pad. Another head consists of an elongated plate having an attached fiberous pad and a liquid distribution header which has a multiplicity of holes along one edge. A resilient connection secured between the head and the handle biases the head to fully contact the floor.

2 Claims, 4 Drawing Figures

MOP ASSEMBLY TO DISTRIBUTE SELECTED LIQUIDS ON FLOOR AREAS, TO BE WAXED, CLEANED, AND/OR STRIPPED

BACKGROUND OF THE INVENTION

Exposed flooring is maintained in various ways of different times utilizing selected liquids, respectively, cleaning, conditioning, and polishing the surface. Waxes, wax strippers, and intermediate cleaning solutions are still typically applied using a bucket and mop combination. The respective liquid is applied to the floor surface by repeatedly soaking the mop in the liquid and applying the liquid with the wet mop to the floor. This is a tedious and time consuming method and generally results in nonuniform distribution of the treatment liquids over the floor surface.

This tedious and slow method is still used; however, there are disclosures of record of apparatus to be used to speed up the process. For example, a liquid reservoir in the form of a tank is often attached to the exterior of a mop handle and also a distribution system is used for dispensing the floor preparation liquid onto the floor surface. Such assemblies are disclosed in U.S. Pat. Nos.: Barbato U.S. Pat. No. 2,618,799; Tillack U.S. Pat. No. 1,995,592; Jenkins U.S. Pat. No. 2,940,104; Ormerod U.S. Pat. No. 3,054,132; Wohl et al. U.S. Pat. No. 3,081,481; Vosvikian et al. U.S. Pat. No. 3,126,573; Gotberg U.S. Pat. No. 3,457,016; and Failing U.S. Pat. No. 3,784,311. These disclosures all indicate such a use of a tank with a dispensing system to eliminate the use of a bucket containing the liquid to receive the mop for its time consuming repeated soaking and the resulting often non-uniform distribution of the liquids.

There remained, however, a need for an improved assembly of a mop handle, liquid tank, and liquid distribution system to incorporate more equipment to insure the uniform distribution to all floor surfaces inclusive of those previously not reached at all or not conveniently reached because of overhead obstructions such as desks, bookcases, tables, beds, etc., and also to make it convenient to flexibly mount different mop heads for particular floor surface treatments, while always assuring uniform contact with a floor surface and uniform distribution of the particular liquid.

SUMMARY OF THE INVENTION

A mop assembly having a low longitudinal cross sectional profile is provided for the efficient and fast uniform distribution of various floor surface treatment liquids to floor areas having both clear and obstructed access. It has its liquid distribution system and relates liquid flow controls protected from hitting both the floor below and obstructions above as the mop assembly is lowered and moved to gain access to floor surfaces underneath desks, cabinets, beds, etc. At all times over all surfaces both those easily reached and those reached with added lower maneuvers at least one full transverse edge of the mop head sub-assembly remains in uniform contact with the floor surface and generally the entire surface of the mop head sub-assembly remains essentially flat against the floor surface. In a preferred embodiment a liquid tank of resilient material is formed to centrally and internally receive a portion of the mop handle. Integral sealable shoulders on the tank receive the mop handle above and below, and clamps secured about these shoulders complete the sealing upon their tightening. This tank is formed somewhat like a tear drop, with a uniform depth or thickness along the mop handle but with its lower portion being transversely wider creating a gradually enlarging lower section, thereby helping to keep the center of gravity of the liquid and consequently the center of gravity of the overall mop assembly as low as conveniently possible, yet keeping the tank at a reasonably high location, so the mop assembly may be used conveniently under furniture and other structures often having low clearances.

The liquid tank has conveniently accessible filling port at its upper end and a discharge port at its lower end for introduction and withdrawal respectively of the floor treatment liquids. To control the withdrawal, a control valve is attached to the discharge port on the tank. A lever arm is provided on the control valve for actuation of the valve and it is formed with a longitudinal slot. A sealable sleeve is installed through the tank from its upper end to the lower end to provide protection for a valve control rod, which might otherwise be damaged, or unwantedly moved thereby varying the liquid flow rate, by contact with obstructions during floor surface treatment operations. The lower end of the valve control rod slidably interconnects with the longitudinal slot on the valve actuator lever arm, so when an operator pushes or pulls on the upper end of the valve control rod, the valve position may be varied and consequently the flow varied of the floor surface treatment liquids.

Various mop heads are interchangeably attached to the lower end of the mop handle. A universal connector is provided to allow the respective heads to pivot. These pivotal mountings are monitored by using a biasing element, such a tension spring or shock cord, which is connected between the mop handle and the front of a respective mop head to hold the rear edge of the mop head against the floor to insure a uniform floor surface coverage, during application of the selected liquids for respectively waxing, stripping wax, and/or interim cleaning the floor surfaces.

A particular form of a mop head to apply wax stripping liquids includes a plate which is universally attached to the end of the mop handle and has a porous pad attached to its bottom, floor contacting surface. A conduit connected with the liquid control valve is connected at its other end to the central portion of the plate at an opening therein to distribute the stripping liquid to the porous pad where it diffuses throughout the pad and then onto the floor surface to be treated.

Another form of the mop head consists of an elongated pad transversely and universally mounted on the end of the mop handle. A liquid distribution header having a plurality of holes in it is attached to the front edge of the pad and is supplied with a selected liquid through an attached flexible tubing which is also attached to the liquid control valve. During floor surface conditioning operations this header distributes a respective liquid along and on the front edge of the pad while the mop head, with an attached suitable pad cover, is preferably pulled behind an operator who is spreading the liquid, during a respective, waxing, wax stripping, and/or interim floor surface conditioning operation.

DESCRIPTION OF DRAWINGS OF THE PREFERRED EMBODIMENT

A preferred embodiment of the mop assembly is illustrated in the drawings wherein.

DETAILED DESCRIPTION OF THE PREFERRED EMBODIMENT OF THE INVENTION

Figure 1:
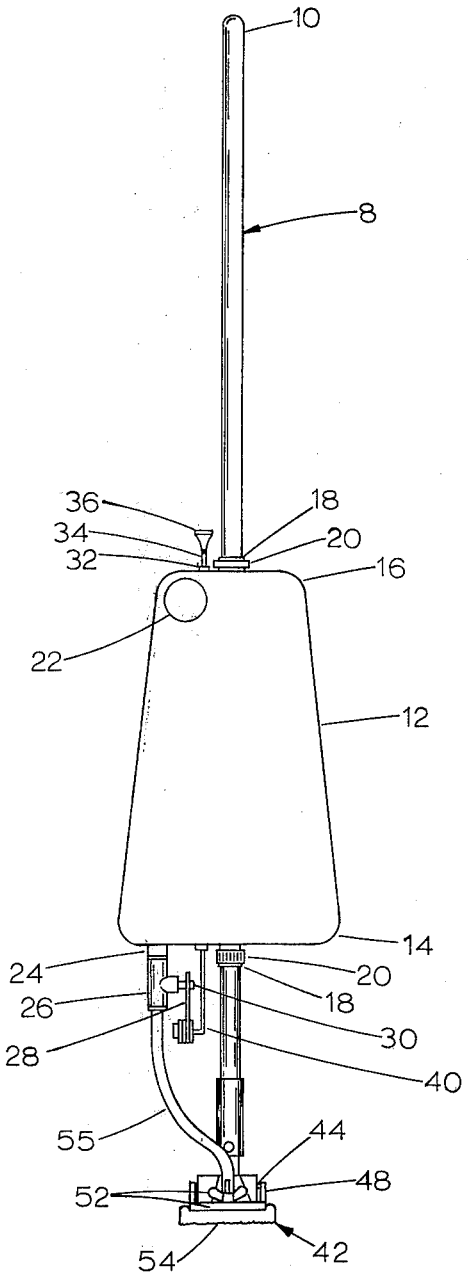
FIG. 1 is a front view of the mop assembly with a wax stripping mop head subassembly installed.
Figure 2:
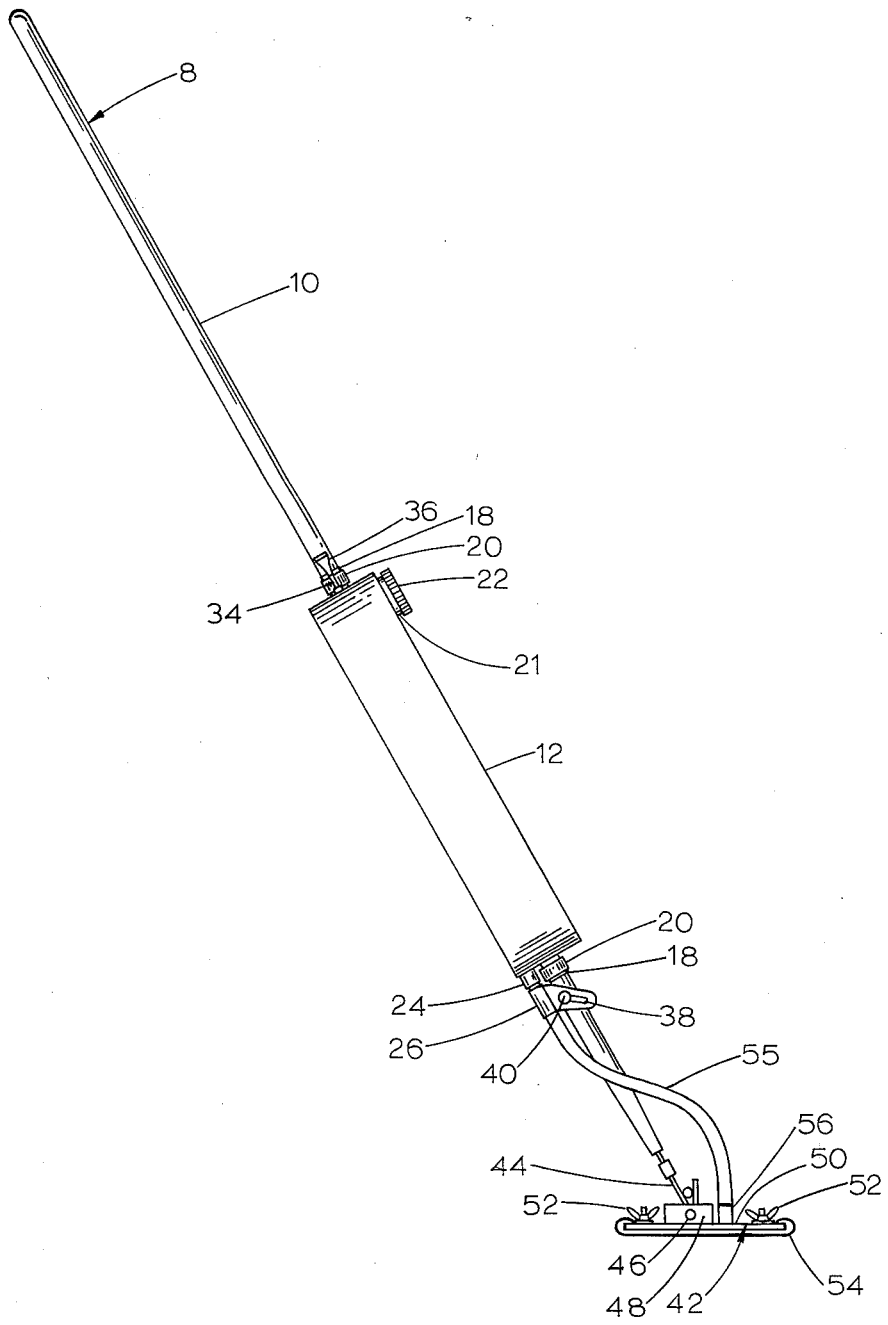
FIG. 2 is a side view of the mop assembly with a wax stripping mop head subassembly installed.

The preferred illustrated embodiment of the mop assembly is utilized to uniformly and controllably distribute and apply respective liquids to the surfaces of exposed floors, which are both readily and also inconveniently accessible, to alternately clean, strip, and/or wax these floor surfaces. FIGS. 1 and 2 illustrate the overall mop assembly equipped with a wax stripping and cleaning mop head subassembly.

The mop assembly 8 has a handle 10 on which a tank 12 is mounted. The handle 10 passes centrally through the tank 12. Preferably, the tank 12 has a tear drop shape, as viewed from the front, in a transverse plane through the mop assembly 8. It is wider at its lower end 14 to carry a larger volume of liquid in the lower end 14, than in the upper end 16. This serves to keep the changing center of gravity of the liquid in the tank lower to make the mop assembly 8 easier to handle. The tank 12 is preferably uniformly and relatively thin in its longitudinal crosssection dimension. Also tank 12, in its preferred form, has like circular shoulders 18 on both its upper and lower ends which surround the openings through which the mop handle 10 passes. Preferably the mop handle has a round cross-section so that when the tank is constructed of plastic material; such as, cross-linked polyethelene, which is chemically resistant and does not develop stress cracking, clamps 20 may be secured about the shoulders 18 to sealably force the shoulders against the surfaces of the handle, while securing the tank at the same time. Aluminum or plastic handles are also suitable. A filling port 21 with a cap 22 is provided in the upper portion of the tank 12 for introducing the respective treatment liquid into the tank 12. A discharge port 24 is provided in the lower portion of the tank for the discharge of the liquid by gravity flow.

A control valve 26 is connected to the discharge port 24 to regulate the flow of the liquid from the tank 12. An actuating lever 28 is attached to a valve control shaft 30. A sealable sleeve 32 passes through the tank 12 from the upper end to the lower end. A control rod 34 having an offset portion 40 in its lower end passes through this sleeve. Its upper end, preferably has a knob 36, which permits the operator to push or pull the control rod 34. The lower end of the rod 34 engages a slot 38 in the actuating lever arm 28 as shown in FIG. 2. Pushing and pulling the knob 36, causes the offset portion 40 of the control rod 34, which is slidably engaged in the slot 38, to force the actuating lever arm 28 to rotate the valve control shaft 30 to in turn change the opening of the liquid control valve 26.

A stripping mop head 42 is attached to the lower end of the handle 10 in any convenient manner which will allow the head to move and be positioned as desired as illustrated in FIGS. 1 and 2. A preferable connection is obtained by using a conventional available spring clip-type connector 44 which removably attaches to a horizontal bar 46, mounted transversely in a bracket 48 on the top of the mop head 42. This permits the head to pivot about the horizontal bar 46. It also permits the simple and quick interchangeability among other mop heads which also have such a bar. This stripping mop head 42 consists of a flat plate 50 having clamps 52 on either end which hold securely the ends of a pad 54. The pad 54 covers the bottom of the plate 50 and also it is wrapped over the ends of the plate 50 and beneath the clamps 52. This stripping pad 54 is preferably made of a coarse porous material.

A distribution conduit 55, such as a flexible piece of tubing 55, preferably made of clear polyvinylchloride, connects the outlet of the control valve 26 to a conduit 56 located on the top of the plate 50, and this conduit 56 passes on through to the bottom of the plate 50. The fluid within the tank 12 is permitted to feed by gravity through the distribution tubing 55 at a rate controlled by positioning the control valve 26. The fluid passes through the plate 50 to the upper surface of the stripping pad 54, and then diffuses throughout this porous pad 54, uniformly onto the floor surface to be treated during the stripping of the old wax.

Figure 3:
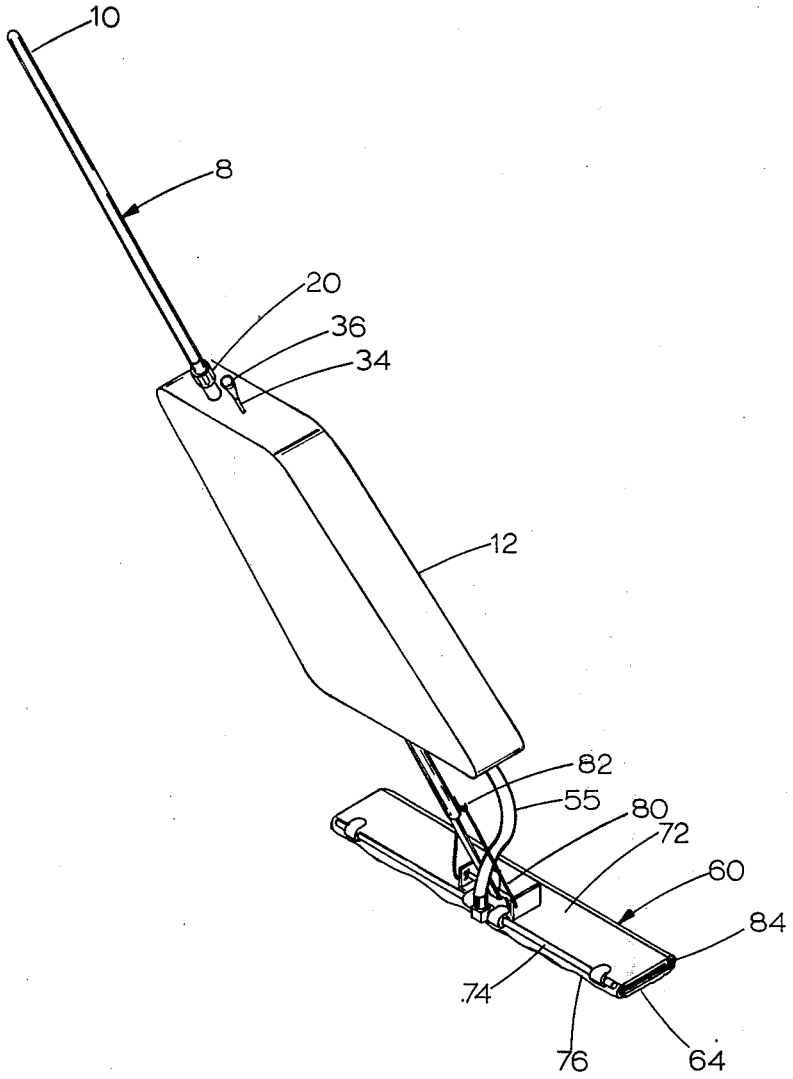
FIG. 3 is a partial view of the mop assembly showing the wax applying mop head subassembly including the liquid distribution system and the universal mounting of the mop head with its resilient positioner.
Figure 4:
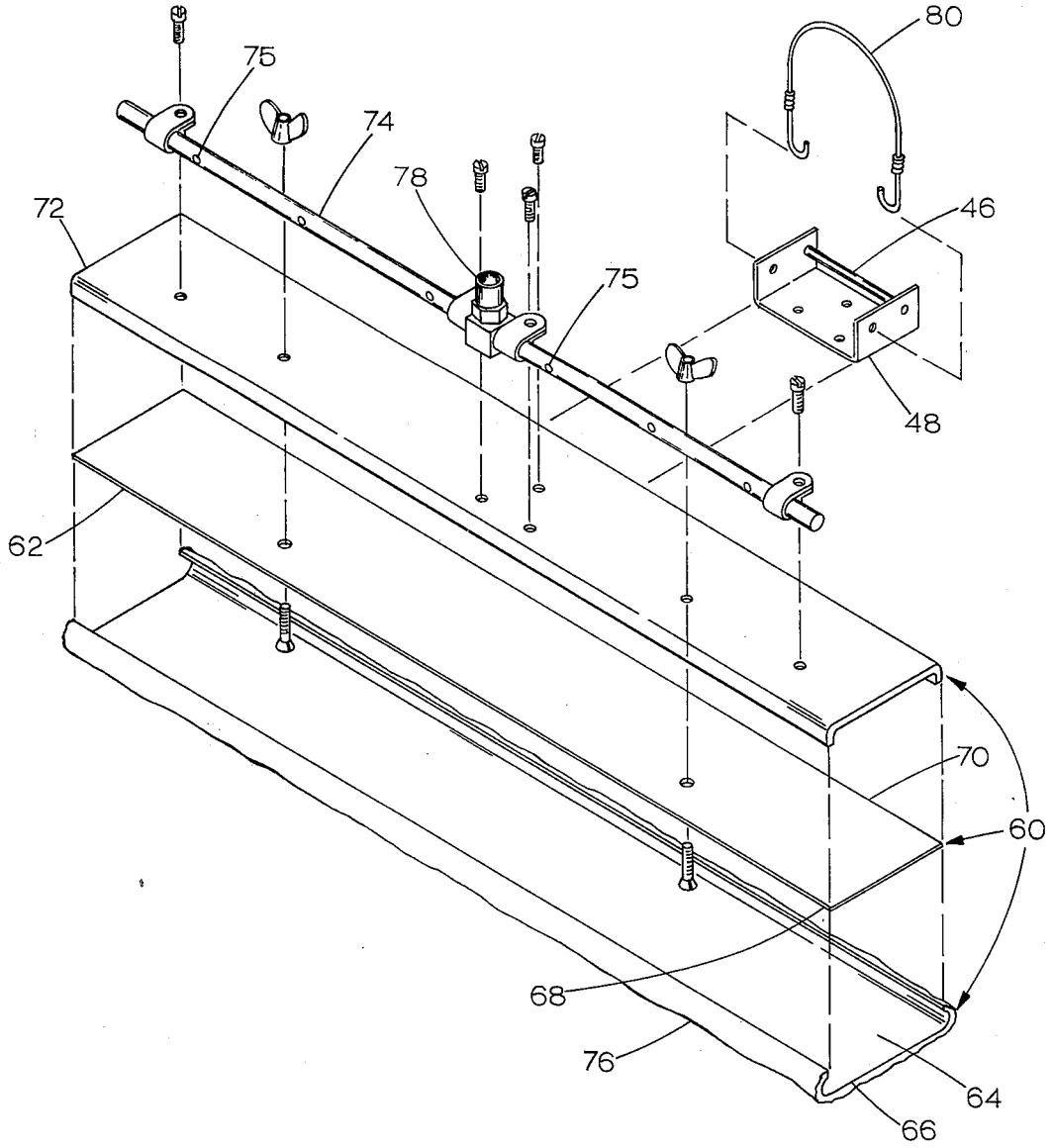
FIG. 4 is an exploded view of the wax applying mop head subassembly shown in FIG. 3.

Another mop head 60, illustrated in FIGS. 3 and 4, is particularly suited for use in applying waxes or interim liquid cleaners to floor surfaces. This mop head subassembly 60 consists of an elongated lower plate 62 to which a mop pad 64 is removably affixed, such as a fabric 64, having long fibers 66 attached to one surface. The mop pad 64 is removably affixed by wrapping its edges around the front edge 68 and rear edge 70 of the plate 62. A second plate or upper plate 72 which may be in the form of a channel 72, preferably narrower than the lower plate 62, is then fastened against the lower plate 62 clamping the pad material 64 securely to the mop head 60. A channel configuration for the upper plate 72, or alternatively the lower plate 62 is preferred, because this channel configuration gives rigidity to the mop head subassembly 60. Without such rigidity the ends of an applicator head would tend to flex upwardly, when the head is forced against a floor, thereby often resulting in an uneven pressure contact of the effective mop pad material with the floor surface.

A liquid distribution header 74 is attached to the front edge of the mop head subassembly 60. It has many small orifice holes 75 along its length to distribute the floor treatment liquids. This header 74 is positioned along the front of the mop head subassembly 60, so the liquid exiting from the orifices 75 is deposited on the leading edge 76 of the mop pad material 64, rather than directly on the floor surface ahead of the mop head subassembly 60, so the liquid transversely continues to disperse as it flows generally downwardly through the fabric of the pad material 64. This results in a more uniform distribution of the liquid as it is further distributed, when the mop head subassembly 60 and mop assembly 8 is drawn over the floor surface to be treated. A connector 78 is provided in the liquid distribution header 74, to receive liquid conduit or tube 55 which is also connected to the tank 12. This mop head subassembly 60 is preferably connected to the handle 10, as previously described in attaching the stripping mop head 42, by utilizing the bracket 48 and bar 46. This mop head subassembly 60, additionally, has attached to it a biasing element such as an elastic band 80, shock cord, or spring which connects between a hook 82 on the mop handle 10 and the mop head subassembly 60 in front of its connection to the handle 10, whereby the rear edge of the mop head subassembly 60 is lowered. This elastic band 80, aids in keeping the trailing edge 84 of the mop head subassembly 60 against the floor surface to assure even distribution of the respective liquids, even when the mop handle 10 is lowered to treat floor surface areas located under low clearance obstacles such as furniture.

In use, the mop assembly 8, with the applicator mop head subassembly 60 installed, is pulled behind the operator rather than pushed ahead of the operator. By controlling the flow rate of a respective liquid, by adjusting the control valve 26, a desired amount of liquid is applied to a floor area. Since the control knob 36 is conveniently located on the top of the tank 12 it is positioned near the hands of the operator and is easily adjusted as necessary. As the operator varies his speed of coverage over the floor surfaces, the flow rate is correspondingly adjusted to keep a uniform coverage, without the necessity of the operator stopping to make an adjustment or keep his speed uniform.

Since the valve control rod 34 passes through the sleeve 32 within the tank 12, it is protected from damage by contact with objects during use, transportation, or storage of the mop assembly 8. Also it is protected from bumps during operation which might otherwise change the liquid flow adjustment. This is particularly important where it is necessary to work on floor surfaces located under and around furniture such as desks, tables, chairs, beds, etc.

The form of the tank 12 allows for a simple inexpensive attachment of the tank 12 on the mop handle 10. With the handle 10 passing through the central portion of the tank 12, rather than the tank 12 being mounted alongside the handle 10, the clearance required under obstructions for any given size of tank 12 is reduced. The preferred teardrop shape of the tank 12, as viewed in one plane, lowers the center of gravity of the liquid, and consequently the overall mop assembly 8, thereby making it easier to handle. The relative thinness of the tank 12, in its other direction, allows the tank 12 to operationally fit under low clearance obstructions.

The use of the mop assembly 8, with the applicator mop head subassembly 60, as shown and described, has, in actual use, permitted the application of floor wax to a large floor, covering 1000 square feet in from two or four minutes. This represents a time savings of approximately 70 to 90% over the still widely used conventional wet mop and bucket method.

By changing the type of treatment liquid and the type of mop head subassemblies and pads, the same one handle mop assembly 8 is used, always more efficiently, for waxing, stripping, cleaning, sealing, mopping, and dusting floors, as the mop head subassemblies and pad materials are alternately changed to provide the best results for a particular floor care operation. Other uses of a mop assembly 10 are undertaken such as applying a releasing liquid to forms for concrete before pouring a foundation or wall.

I claim:

1. A mop assembly for distributing liquids on a floor area comprising an elongated handle having an upper end to be grasped by an operator, an elongated mop head pivotally attached to the lower end of said handle, a tank carried by and surrounding a portion of said handle, said handle extending through said tank centrally thereof, means on said tank sealingly securing said tank to said handle portion, said tank being generally rectangular in horizontal section and having its major axis essentially parallel to the axis of said mop head, said tank having an upper filler opening and a lower outlet opening, a flexible conduit connecting said outlet opening to said mop head, a valve in said conduit, a sleeve extending through said tank from top to bottom generally parallel to said handle and valve operator means connected at one end to said valve and extending through said sleeve, the opposite end of said operator means projecting exteriorally of the tank.

2. A mop assembly for the rapid placement of treatment liquids on large floor areas, both unobstructed and obstructed under furniture, comprising, a handle having an upper and lower end, a mop head pivotally attached to the lower end of the handle, having a front and rear edge, means for biasing the front edge of the mop head relative to the handle to direct the rear edge of the mop head against the floor when the mop handle is lowered to pass the mop head under furniture, a tank, for carrying a floor surface treatment liquid, mounted on the handle and having top and bottom openings to permit the handle to pass centrally through the tank, and also having a discharge port in a lower end and a filling port, and having overall dimensions to permit use of the mop assembly in low clearance areas, such as floor areas located under furniture, means for distributing the floor treatment liquid on the floor, a control valve located between the tank discharge port and the distribution means and having an actuating lever, to control the liquid flow rate from the tank, a sleeve passing through the tank from above to below, and a valve control rod passing through the sleeve within the tank for protection of the valve control rod, and having its lower end connected to the actuating lever, so the control valve is actuated by pushing and pulling the upper end of the valve control rod.

* * * * *